US005669055A

United States Patent [19]

Thayer et al.

[11] Patent Number: 5,669,055

[45] Date of Patent: Sep. 16, 1997

[54] DUAL BRUSH CLEANER RETRACTION MECHANISM AND VARIABLE INERTIA DRIFT CONTROLLER FOR RETRACTABLE CLEANER

[75] Inventors: Bruce E. Thayer; Dennis G. Gerbasi, both of Webster; Norman E. LaTour; Christopher B. Miller, both of Rochester, all of N.Y.

[73] Assignee: Xerox Corporation, Stamford, Conn.

[21] Appl. No.: 624,160

[22] Filed: Mar. 29, 1996

[51] Int. Cl.[6] ..... G03G 21/00

[52] U.S. Cl. ..... 399/345; 399/71

[58] Field of Search ..... 355/296, 297, 355/301; 15/21.1, 22.2, 88.2, 88.3; 399/71, 343, 345, 353

[56] References Cited

U.S. PATENT DOCUMENTS 4,449,241 5/1984 Nakayama .
4,519,699 5/1985 Mayer et al. .
4,669,864 6/1987 Shoji et al. .
4,969,015 11/1990 Sanpe .
5,083,169 1/1992 Usui et al. .
5,237,377 8/1993 Harada et al. .
5,412,461 5/1995 Thayer .
5,442,422 8/1995 Owens, Jr. et al. .
5,450,186 9/1995 Lundy .
5,493,383 2/1996 Pozniakas et al. .

*Primary Examiner*—Sandra L. Brase
*Attorney, Agent, or Firm*—T. L. Fair

[57] ABSTRACT

An apparatus in which a six bar linkage cleaner brush retraction/engagement mechanism enables brush retraction (and engagement with the photoreceptor) while providing good control over the brush interference and the capability of changing all of the timing parameters through clutch actuation times in software and clutch shaft speed. The mechanism allows the brushes to retract and engage the photoreceptor independently of one another with relatively soft contacts to the photoreceptor to minimize impacts to photoreceptor motion quality. A four position clutch is used to provide magnetic pole sensor outputs to the system controller to decide when the clutch, which drives the six bar linkage, is engaged and disengaged. The index wheel of the clutch has four equally spaced magnets that are located relative to the retraction crank shaft so that there is a significant amount of time between detecting a pole and the corresponding desired state. An encoder is used to monitor the mechanical drift of each cleaner state.

23 Claims, 8 Drawing Sheets

DUAL BRUSH CLEANER RETRACTION MECHANISM AND VARIABLE INERTIA DRIFT CONTROLLER FOR RETRACTABLE CLEANER

BACKGROUND OF THE INVENTION

This invention relates to an electrostatographic printer or copier, and more particularly to a dual brush retraction mechanism.

In the image on image, multipass color process, four cycles of the photoreceptor are required to develop each color (cyan, magenta, yellow, black) prior to transfer. To prevent disturbance of these images as they are being developed, the cleaning subsystem is required to retract from the photoreceptor during the development cycle. Following transfer, the cleaning elements must engage the photoreceptor, clean the residual toner, and then retract to allow development of the next set of prints. For maximum efficiency, these retraction and engagement cycles for the cleaner need to occur in the interdocument zones on the photoreceptor. For some color product machines, a dual electrostatic brush cleaner is used for its cost, size, cleaning performance and reliability. The problem in such cleaning systems has been the identification of a mechanism to retract and engage each brush sequentially while allowing a large tolerance in the location of the photoreceptor relative to the cleaner, timing flexibility, reasonable cost and reliable operation.

Previous brush retraction mechanisms or systems to accomplish the above-described functions include the following. One such system is the use of solenoids attached to a mechanism to retract each brush. The space constraints for the large solenoids required to compress the brushes against the photoreceptor limit this system's application. Additionally, the lack of repeatable engagement timing, as the solenoids heat up, is a further limitation.

A second brush retraction system is the use of cams to move the brush assemblies about their pivots. However, experimentation showed that using a cam for each brush for retraction and engagement in the brush housings was undesirable because the two cams had to be synchronized to each other in order to maintain the timing required to match each brush motion to the motion of the interdocument zone under the cleaner. While it is possible to use a single cam containing lobes for each of the brushes, the size of the cam required would be very large for most applications. Other drawbacks to the use of cams include the lack of adjustment in the timing between the two brush motions, and the high accelerations occurring as the cam follower drops off of the high portions of the cam lobes which could cause photoreceptor motion quality disturbances.

A third brush retraction system would be to use a stepper motor drive for each brush assembly rotation about its pivot. This system would allow a large degree of adjustment in the timing of each of the brushes retraction and engagement and repeatable performance. However, the motors required are very large and expensive.

The following disclosures may be relevant to various aspects of the present invention and may be briefly summarized as follows:

U.S. Pat. No. 4,669,864 to Shoji et al. to disclose an image forming apparatus having a cleaning device arranged on the outer periphery of an image retainer, and bringing into and out of abutment against the image retainer, wherein the cleaning device comprises a first cleaning member and a second cleaning member arranged downstream of the first cleaning member in the moving direction of the surface of the image retainer. A cleaning operation of the second cleaning member against the image retainer is conducted according to a time at which the cleaning operation of the first cleaning member against the image retainer is conducted.

U.S. Pat. No. 5,412,461 to Thayer discloses an apparatus in which a photoreceptor cleaning blade is mounted to an extension of the coupler link of a four bar linkage. A torsion spring is positioned at the pivot of the crank link to create the torque on the crank link. A weight or solenoid can also be used to create the torque on the crank link. This torque supplies the force to the mounted cleaning blade. The instantaneous center of rotation is a virtual pivot point which is located on the photoreceptor tangent plane. The linkage reaction forces and the blade friction load all pass through the virtual pivot point leaving the blade load a function of the torque on the crank link. In machines where the cleaning blade is located on a long span of a belt photoreceptor this offers the advantage of blade loading insensitivity to friction without trapping the photoreceptor inside pivot bearings.

U.S. Pat. No. 5,442,422 to Owens, Jr. et al. to disclose an apparatus for cleaning an imaging surface with a hybrid cleaner that includes the implementation of a contamination seal in the cleaner unit. The contamination seal captures falling accumulated toner from the blade edge and in the brush nip, due to gravitation, which contaminates the xerographic area when the cleaner blade and disturber brush are retracted from the imaging surface. The contamination seal rests along the length of the blade portion that extends from the blade holder. In this position, the contamination seal does not touch the imaging surface to cause scratches nor does it interfere with the blade's ability to clean the imaging surface. Implementation of the contamination seal contains toner emission within the cleaner from the blade edge and brush nip.

U.S. Pat. No. 5,450,186 to Lundy discloses a flexible cleaner brush belt that increases the brush belt life by flexing away from the photoreceptor when not in use. The flexible belt is lifted away from contact with the photoreceptor and placed back into contact with the photoreceptor by a camming device. A camming device attached to linkages, increases the diameter of the flexible brush belt to lift the brush belt away from contact with the imaging surface. The camming device urges the belt brush back into contact with the imaging surface by decreasing the diameter of the brush belt. This movement of the brush belt increases the brush belt life and does not cause print quality defects, excessive toner clouding, or loss of machine productivity.

SUMMARY OF INVENTION

Briefly stated, and in accordance with one aspect of the present invention, there is provided an apparatus for cleaning particles from a movable surface of a multipass image on image printing machine, comprising: at least two means for cleaning the surface including a first cleaning means and a second cleaning means, the first cleaning means being located upstream from the second cleaning means in a direction of motion of the surface; and a mechanism for pivotally supporting the first cleaning means and said second cleaning means, having an actual pivot point on an axis parallel to and above the surface and perpendicular to the direction of motion of the surface, the mechanism enabling the first cleaning means and the second cleaning means to sequentially retract from and engage with the surface.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Figure 11:
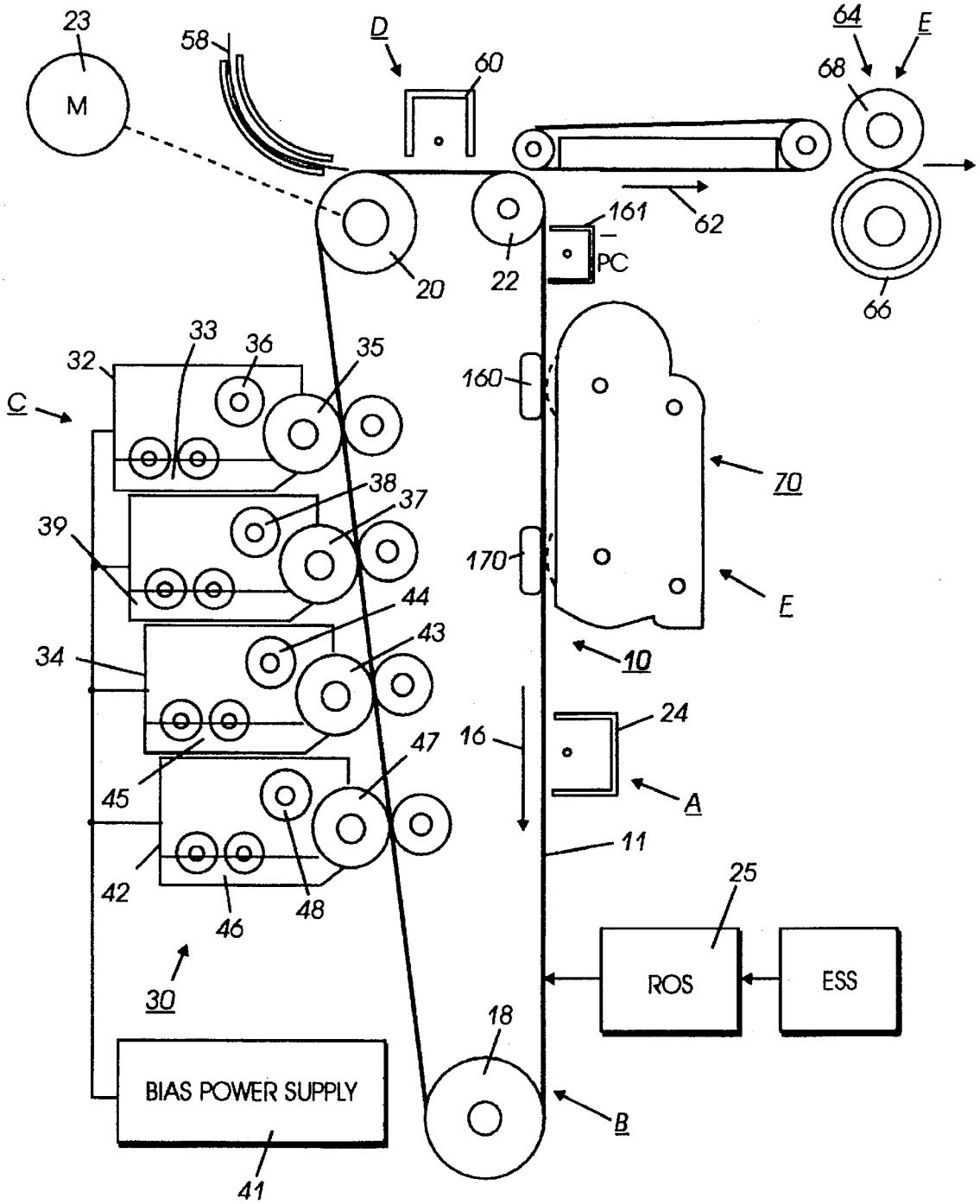
FIG. 11 is a schematic illustration of a printing apparatus incorporating the inventive features of the present invention.

Referring now to the drawings, where the showings are for the purpose of describing a preferred embodiment of the invention and not for limiting same, the various processing stations employed in the reproduction machine illustrated in FIG. 11 will be briefly described.

A reproduction machine, from which the present invention finds advantageous use, utilizes a charge retentive member in the form of the photoconductive belt 10 consisting of a photoconductive surface and an electrically conductive, light transmissive substrate mounted for movement pass charging station A, and exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 18 to advance belt 10 in the direction of arrow 16. Roller 20 is coupled to motor 23 by suitable means such as a belt drive.

As can be seen by further reference to FIG. 11, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device 24, Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device (for example a two level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first 42, second 40, third 34 and fourth 32 developer apparatuses. (However, this number may increase or decrease depending upon the number of colors, i.e. here four colors are referred to, thus, there are four developer housings.) The first developer apparatus 42 comprises a housing containing a donor roll 47, a magnetic roller 48, and developer material 46. The second developer apparatus 40 comprises a housing containing a donor roll 43, a magnetic roller 44, and developer material 45. The third developer apparatus 34 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls 35, 37, 43, and 47 then develop the toner onto the imaging surface 11. It is noted that development housings 32, 34, 40, 42, and any subsequent development housings must be scavengeless so as not to disturb the image formed by the previous development apparatus. All four housings contain developer material 33, 39, 45, 46 of selected colors. Electrical biasing is accomplished via power supply 41, electrically connected to developer apparatuses 32, 34, 40 and 42.

Sheets of substrate or support material 58 are advanced to transfer D from a supply tray, not shown. Sheets are fed from the tray by a sheet feeder, also not shown, and advanced to transfer D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually, Residual toner and debris remaining on photoreceptor belt 10 after each copy is made, may be removed at cleaning station F with a brush or other type of cleaning system 70. The cleaning system is supported under the photoreceptive belt by two backers 160 and 170. A negatively biased preclean 161 is located upstream from the cleaning system in the direction of motion of the photoreceptor 10.

Figure 1:
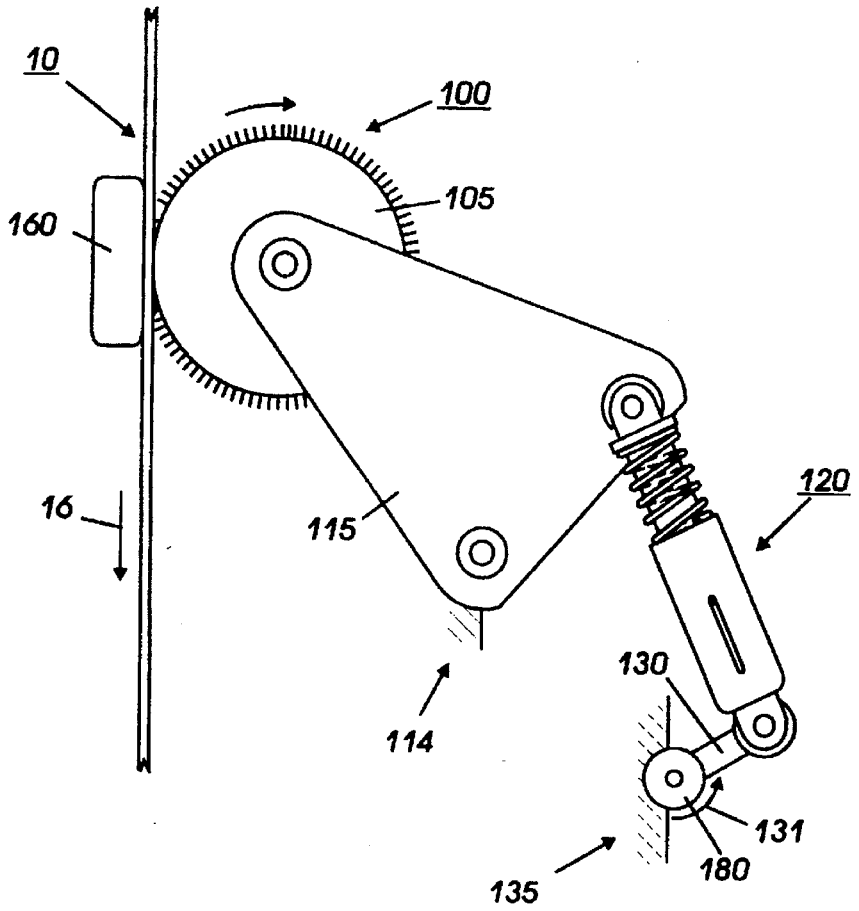
FIG. 1 is a schematic of the four bar linkage of the present invention attached to the first cleaner brush.
Figure 2A:
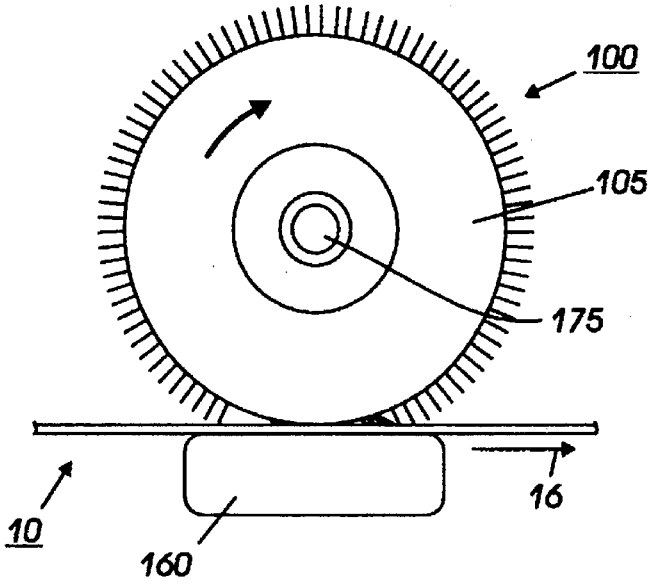
FIG. 2A is a side view of an interference wheel that controls interference between a brush and the photoreceptor.
Figure 2B:
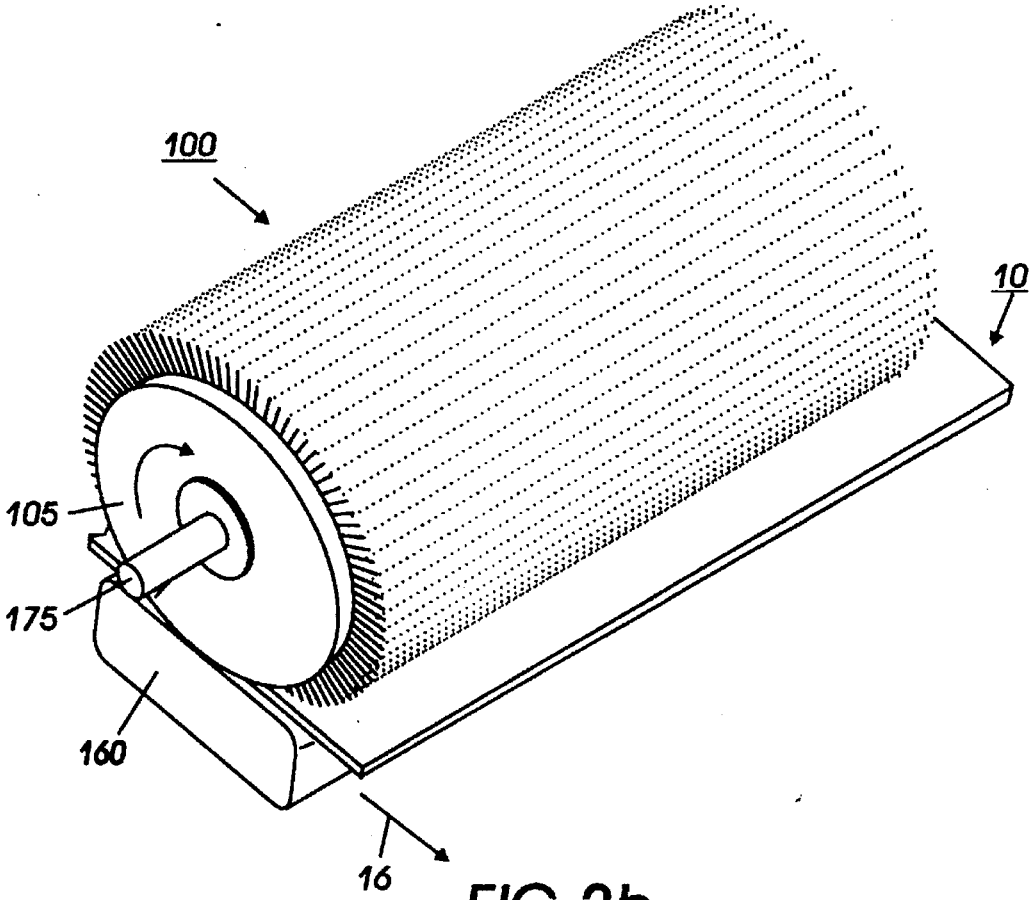
FIG. 2B is a perspective view of FIG. 2A.
Figure 4:
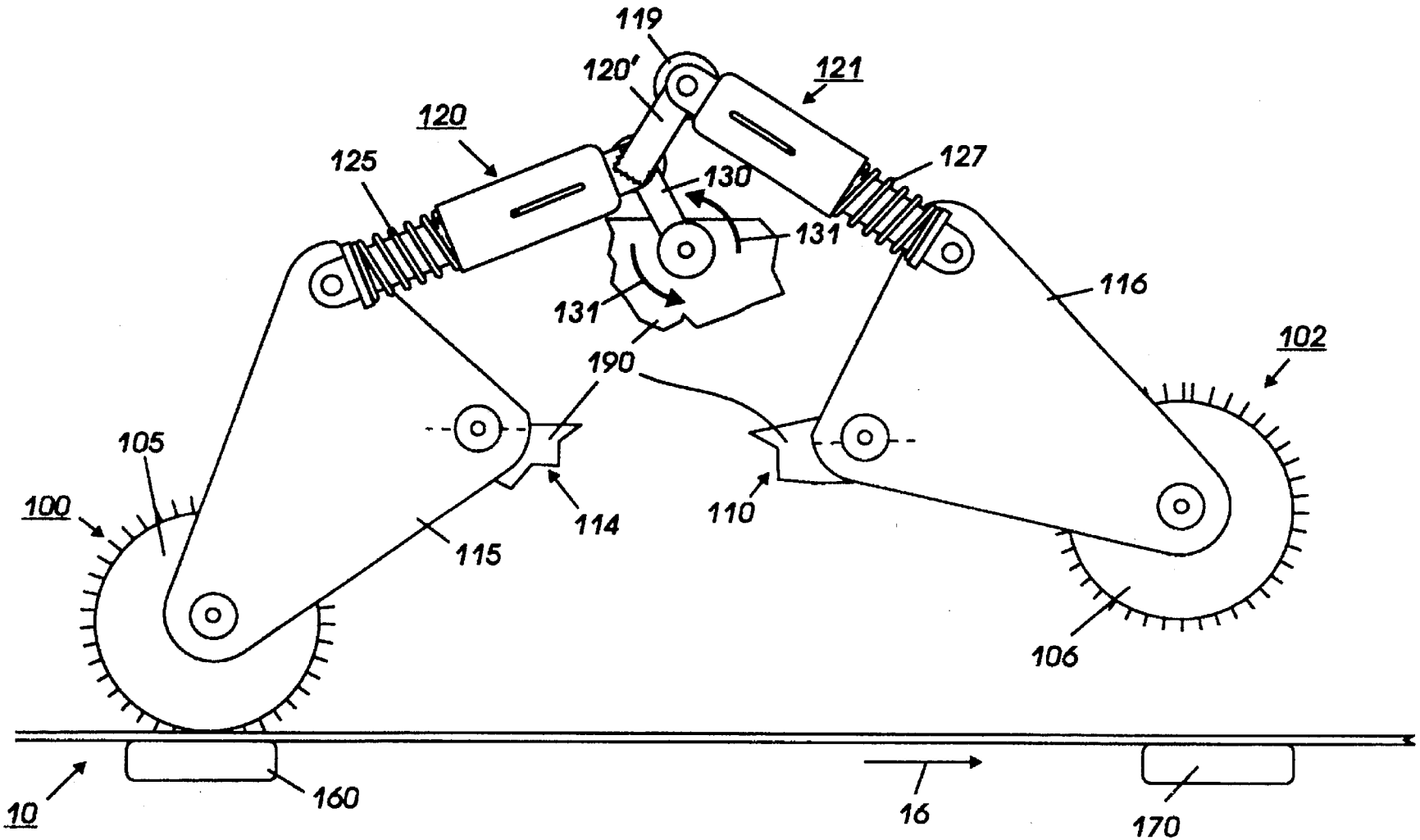
FIG. 4 is a schematic view of the six bar linkage of the present invention for retraction of a dual brush cleaner

In the present invention, a six bar linkage is used to retract and engage the cleaner brushes. Reference is made to FIG. 1, which shows a schematic of the first brush being retracted by four bars of the six bar linkage. The frame link 190 is shown in FIG. 4. The rocker link 115 is the endplate with a pivot point 114. The crank link 130 is mounted symmetrically between the two brushes 100, 102 (see FIG. 4) and on the opposite side of the cleaner endplate from the photoreceptor 10. The coupler link 120 connects the crank link 130 to the rocker link 115. As the crank rotates (see arrow 131 ) the coupler 120 transmits motion to the follower 115 (e.g. rocker) causing it to move toward and away from the photoreceptor. Reference is now made to FIGS. 2A and 2B which show frontal and side views, respectively, of an interference wheel that enables interference between a brush and a photoreceptor to occur with little tolerance variation. The crank motion, of the present invention, is controlled by a clutch 200 (see FIG. 10) which engages and disengages causing the retraction crank shaft, 180, to rotate. The engaged clutch allows the retraction crank shaft 180 to rotate 180 degrees to retract the cleaner brush and then is disengaged, causing the retraction crank shaft to stop rotating. Upon disengaging the clutch, the internal resistance drag of the cleaner due to seals, brush compression, etc. causes the brush motion to stop. Due to the large tolerance (i.e. ±3 mm) on the location of the photoreceptor 10 relative to the cleaner housing the brush shaft 175 carries an interference wheel 105 which contacts the photoreceptor backer 160 outside of the photoreceptor belt path and prevents the brush 100 from being over compressed.

Figure 3:
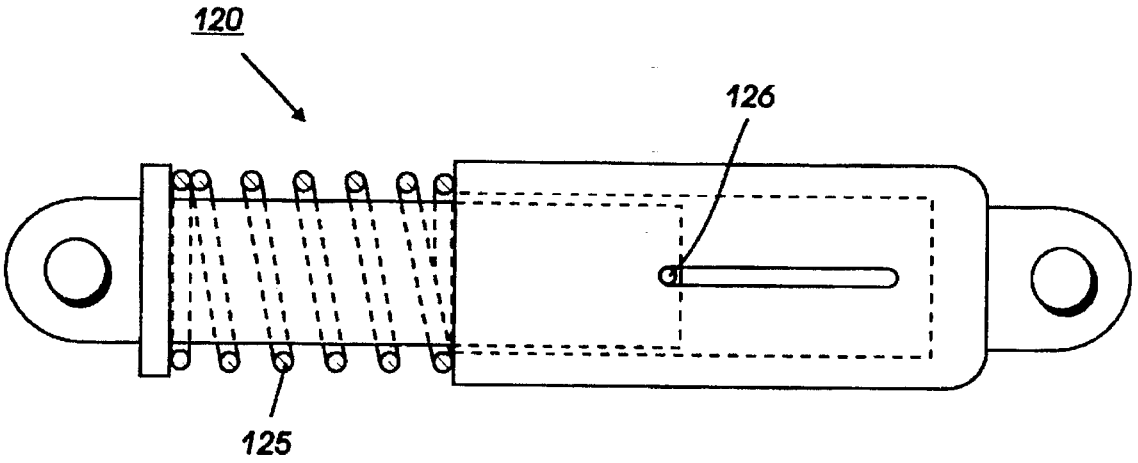
FIG. 3 is a schematic view of the compressible coupler link.

Reference is now made to FIG. 3 which shows a schematic view of a compressible coupler link in the present invention. To ensure that the individual brush interference with the photoreceptor is sufficient, the four bar linkage (see FIG. 1) enables the motion required for nominal brush interference to be exceeded. Since the interference wheels will stop the brushes when they contact the backer bars the coupler link must be made compressible. The coupler link 120 consists of two telescoping portions which are spring loaded. When the brush is not contacting the photoreceptor, the spring 125 maintains the coupler link 120 in an extended position. A pin 126 prevents rotation of the two coupler link 120 halves and limits extension of the coupler link. When the interference wheels contact the backer rollers or bars 160 (see FIGS. 2A and 2B), the rocker link 115 stops rotating, the crank link 130 continues to rotate and the coupler link 120 compresses the coupler spring 125 and the two telescoping coupler link pieces slide over one another to a retracted position.

Reference is now made to FIG. 4 which shows a schematic view of the six bar linkage, of the present invention, for retraction of a dual brush cleaner. Like the first brush 100, described in FIG. 1, the second brush 102 must also be retracted and engaged to the photoreceptor 10. In order that the retraction and engagement of the second brush always occurs in the interdocument zones (i.e. the area between the imaging regions on the imaging surface) of the photoreceptor 10, the second brush 102 always lags the engagement or retraction motion of the first brush 100 by the time it takes the interdocument zone to move the distance between the two brushes 100, 102. To create this "lag", the second brush 102 is also moved by a four bar linkage but, rather than being driven directly by the crank link 130, the second brush is driven by an extension 120' of the coupler link 120 for the first brush four bar linkage. The connection point 119 to the first brush coupler link 120 is chosen such that the motion of the second brush 102 lags behind that of the first brush 100, in the direction of motion of the photoreceptor 10 shown by arrow 16. A six bar linkage (rather then an eight bar linkage) is used for a dual brush cleaner because the second brush 102 (located downstream from the first brush in the direction of motion of the photoreceptor shown by arrow 16) four bar linkage has the frame link in common with the first brush four bar linkage and uses the first brush coupler link 120 to drive the second brush 102, only two additional links 121 (i.e. coupler link) and 116 (i.e. rocker or follower link) are required for a dual brush cleaner retraction system. The rocker link 116 has a pivot point 110. Hence, the entire two brush retraction system includes a six bar linkage.

Reference is made to FIGS. 5A–5D which show, sequentially, the four position actuation timing of the present invention. The lag in retraction and engagement of the two brushes built into the six bar linkage does not allow any variation in lag timing or variation in lag timing versus retraction timing. These timing factors must be designed into the six bar linkage. The distance between the brushes on some cleaner and the speed and size of the interdocument zones were such that the design of a six bar linkage which would satisfy all of these requirements did not fit into the architecture of the printing machine. To avoid this problem and supply timing flexibility, a clutch (or stepper motor or like device) is used. This clutch has an intermediate stopping point between the 180° stops for each retraction and engagement cycle of the brushes.

Figure 5A:
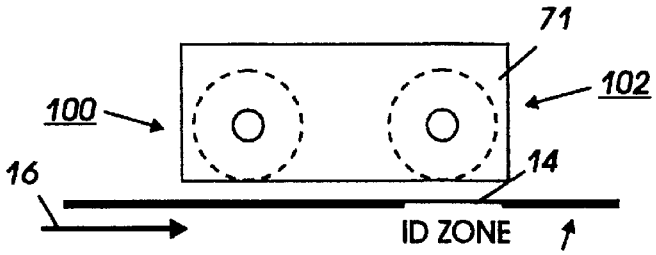
FIGS. 5A–5D show sequentially the four position clutch actuation timing of the present invention.
Figure 5B:
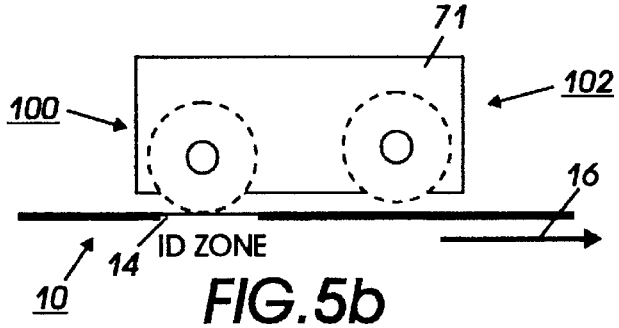
Figure 5C:
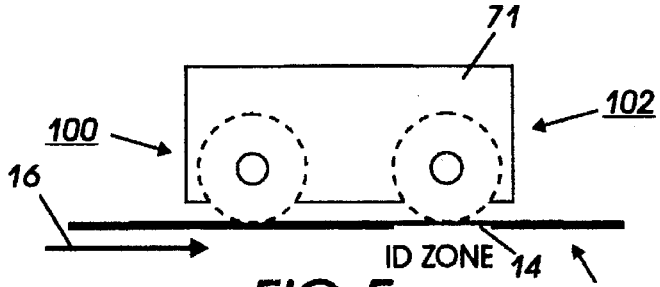
Figure 5D:
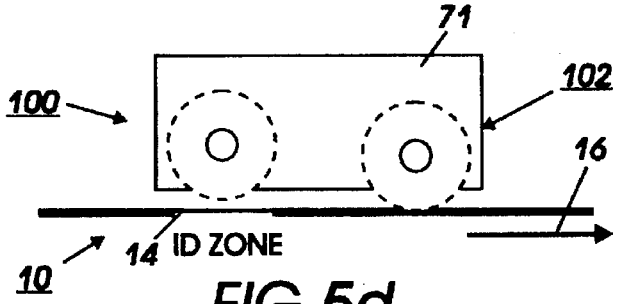

In FIG. 5A both brushes 100, 102 are in the "home position" (i.e. both brushes 100, 102 are retracted from the photoreceptor 10). The operation for engagement is to actuate the clutch to a first position, causing the first brush 100 to engage the photoreceptor 10 in the interdocument zone 14 and the second brush 102 to move part of the way towards the photoreceptor 10 but not contact it. (See FIG. 5B.) The second clutch actuation waits for the interdocument zone 14 to move toward the second brush 102. On the second clutch actuation, the second brush 102 moves the remainder of the distance to contact the photoreceptor 10 in the interdocument zone 14 and the first brush linkage (see FIG. 1) over extends, compressing the coupler link. At this point, the clutch is in the second position and has rotated 180° from the start position and both brushes 100, 102 are engaged with the photoreceptor 10. (See FIG. 5C.) To retract the brushes 100, 102, the clutch is actuated to a third position. This retracts the first brush 100 partially away from the photoreceptor 10 and leaves the second brush 102 in contact with the photoreceptor 10. The retraction cycle then pauses to wait for the interdocument zone 14 to move to the second brush 102. (See FIG. 5D.) The clutch then actuates to the fourth position which completely retracts the first brush 100 and the second brush 102, returning to the original home position. (See FIG. 5A.)

Figure 6:
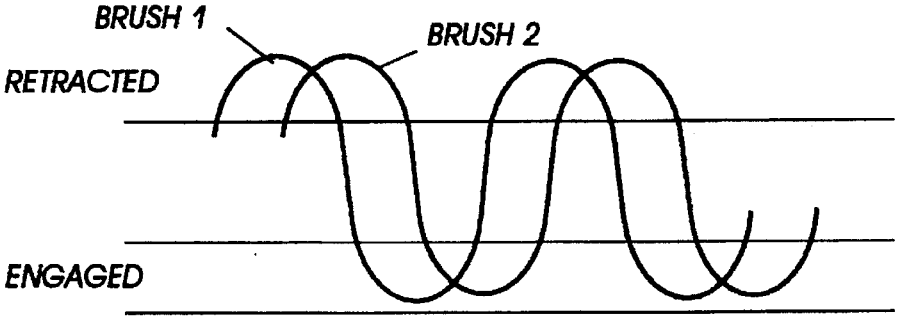
FIG. 6 is a graphical depiction of two brushes about 90 degrees out of phase.

The six bar linkage retraction system enables the two brushes of the dual electrostatic retractable brush cleaner to disengage from the photoreceptor, independently, at the arrival of the interdocument zone ahead of the developed color multipass (untransferred) image. After transfer, the six bar linkage retraction system enables the two brushes to engage the photoreceptor, independently, at the arrival of the interdocument zone, ahead of the untransferred image. In order to accomplish this mechanical movement of the two electrostatic brush cleaners, the brushes are linked to a single retraction crank shaft 180. The rotation of the retraction crank shaft 180 is controlled by a clutch (also referred to as a retraction clutch). When the retraction clutch is engaged, the retraction crank shaft 180 spins, and the linkage causes the two brushes to move. The movement of the two brushes is out of phase by approximately 90 degrees as shown by FIG. 6. Although the two electrostatic brushes are always in motion when the retraction clutch is engaged, there are four distinct cleaner positions as described above in FIGS. 5A–5D. (i.e. The positions are both brushes retracted, the first brush engaged and the second brush retracted; both brushes engaged; and the first brush retracted and the second brush engaged.) These four cleaner positions (or four states) occur during one revolution of the retraction crank shaft. If the approximate speed of the retraction crank shaft is about 240 rpm then, the four cleaner states can occur in approximately 250 msec, if the retraction clutch is engaged continuously.

Figure 7:
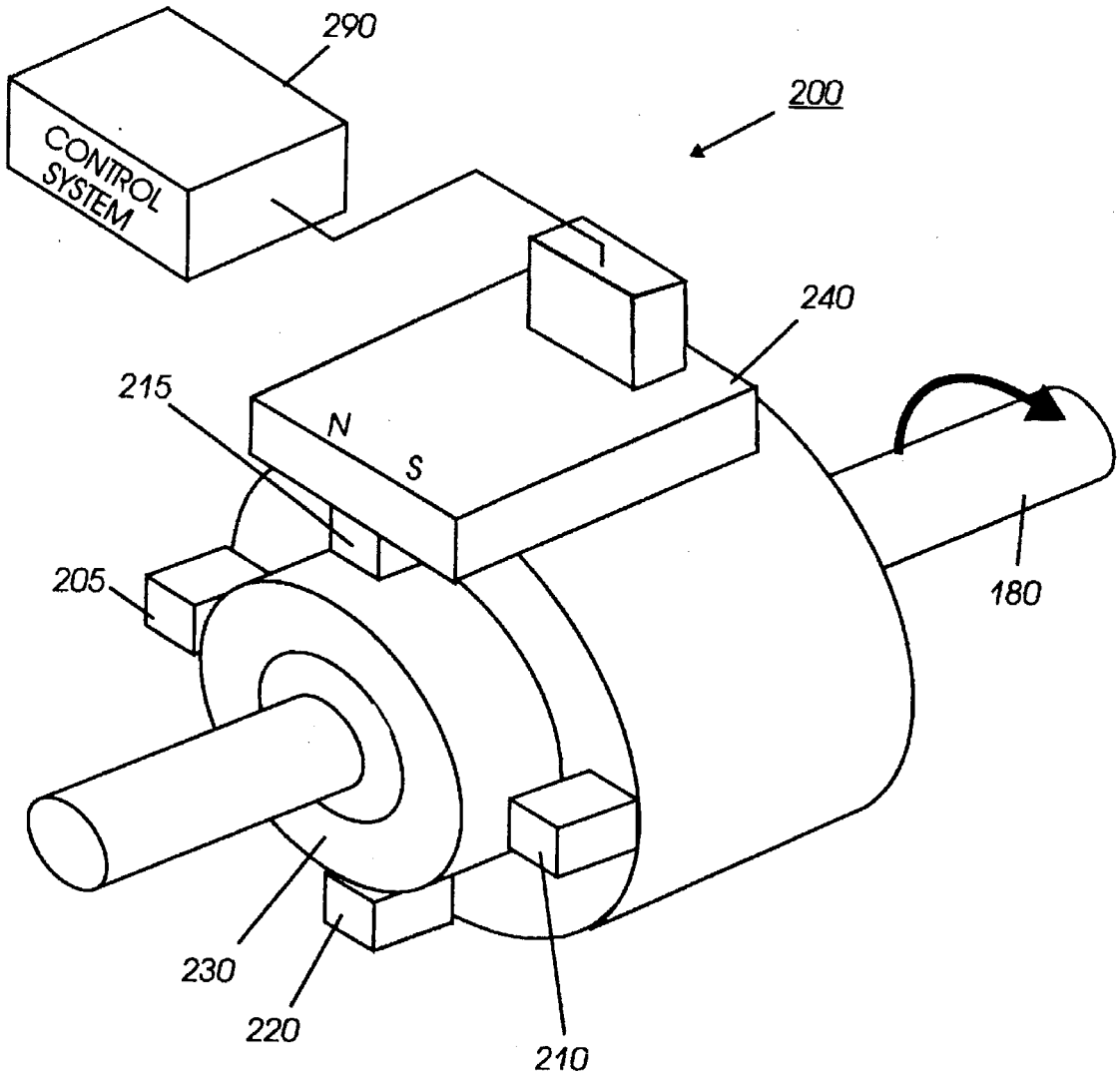
FIG. 7 is an isometric schematic of a four-position self-indexing clutch.

Reference is now made to FIG. 7, which shows an isometric view of the four-position self-indexing clutch to control the retraction engagement of the dual brush cleaner. The clutch 200 has four magnetic poles (205, 210, 215, 220) spaced equally around it's index wheel 230. Three of the poles are magnetic south 205, 210, 215 and the fourth pole is magnetic north 220. The four position clutch 200 can sense its position through the use of a device such as the Hall effect sensor and four magnets. The home position is sensed with a north pole and the other positions are sensed using south poles. This allows the mechanism to always be capable of returning to a known home position to reset the retraction and engagement process. (Four position clutches other than those using magnets and Hall effect sensors, could also be used.) The use of a four position clutch allows changes in the lag time between retraction and engagement motions of the first brush and the second brush. It also allows changes in the time used to retract a brush within an interdocument zone by changing the clutch shaft speed as well as the clutch actuation timing.

With continuing reference to FIG. 7, a sensor 240 on top of the clutch 200 will detect a north pole or a south pole when it passes by. Ideally, the north pole 220 corresponds to the cleaner state or position where the first brush and the second brush are retracted (see FIG. 5A). The south poles 205, 210, 215 correspond to the other three states (see FIGS. 5B–5D). When the clutch sensor 240 detects a pole, the clutch 200 is disabled. However, a problem arises in that there is a finite amount of processing time to disable the clutch 200, because the cleaner has mechanical drift and continues to move for some time after the clutch 200 is disabled. This drift can vary from pole to pole as the inertia of the linkage is different throughout the cycle, and also change due to variations in frictional force with time and wear.

Potential remedies of this clutch disablement problem include: rotating the magnetic poles with respect to a keyed retraction clutch shaft 180 so that the magnetic poles can be detected by the sensor before the cleaner reaches the desired cleaner state by a sufficient amount to compensate for the shut-off time and the mechanical drift. However, this will not compensate for variation in the mechanical drift from state to state, unless the mechanical drift is basically constant for a complete linkage cycle (which is unlikely). Another solution is to give each pole a unique offset which is matched to the mechanical drift of it's corresponding state, but this solution is costly and at best, temporary because it resolves drift problems initially but not once the cleaner has aged and the drift has changed. Still another solution is to add a brake to the retraction drive shaft to reduce the drift of the cleaner, thereby making the brake strong enough to reduce the drift of the cleaner over the life of the cleaner. Unfortunately, torque requirements, increased cleaner UMC (i.e. unit manufacturing costs), decreased reliability, and increased drive cost to the cleaner are added.

The preferred embodiment involves modifying the retraction clutch and using an encoder wheel to monitor the mechanical drift of each cleaner state. The main modifications to the retraction clutch are two fold. First, the self-indexing feature of the clutch (described above) is disconnected, and the magnetic pole sensor outputs are made available to the system controller 290 (see FIG. 10) enabling the system controller to decide when the clutch is engaged and disengaged. Second, the equally spaced poles on the index wheel 230 are rotated with respect to the keyed retraction crank 180 so that the magnetic poles can be detected by the sensor before the cleaner reaches the desired cleaner state. At a clutch input speed of 240 rpm, a pole is seen every 90 degrees, or every 62.5 msec. Offsetting the poles by 45 degrees, for example, would allow the controller to disable the clutch from 0 to 31.25 msec. If the controller measures the drift of the cleaner at each state, software can be used to calculate the amount of time to wait before disabling the clutch at each state. This method is adaptable to variations in cleaner drift with manufacture and wear over time.

Figure 8:
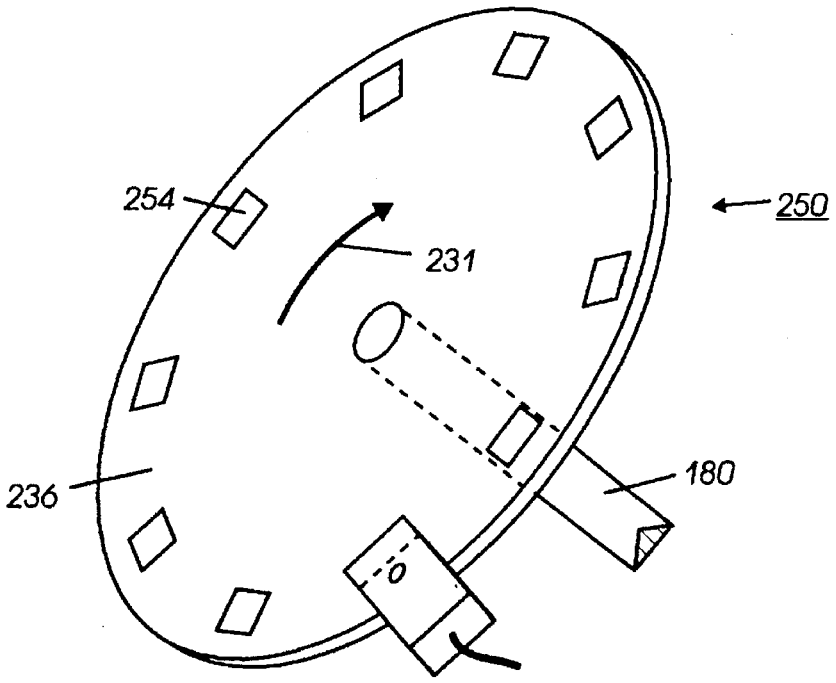
FIG. 8 is a schematic of an encoder in the present invention.
Figure 9A:
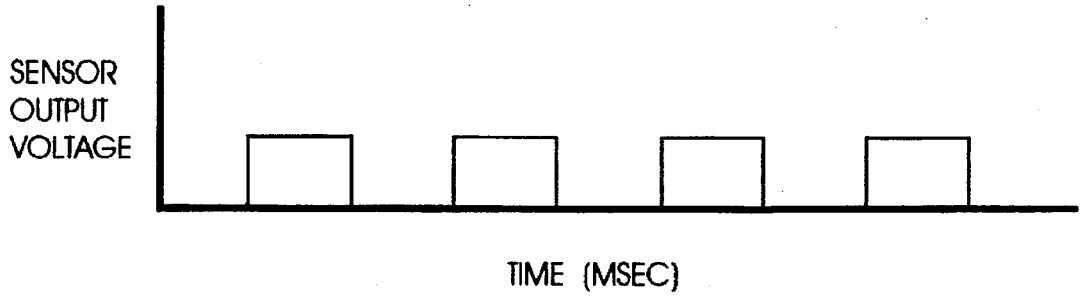
FIGS. 9A and 9B are graphical depictions of encoder pulses.
Figure 9B:
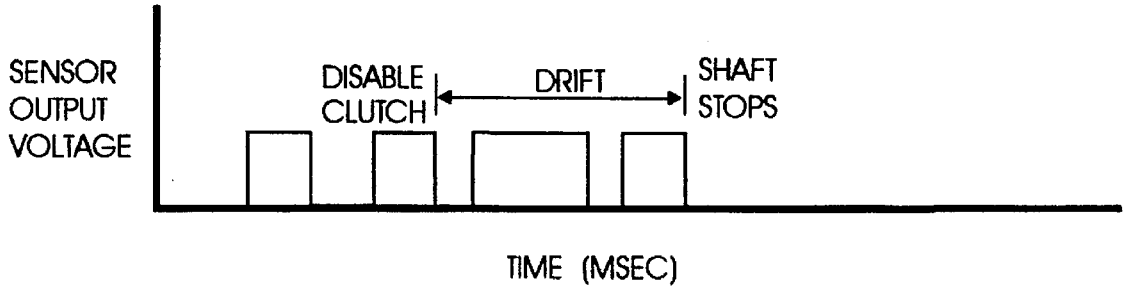

Reference is now made to FIG. 8 which shows a schematic of an encoder. The encoder wheel 236 is attached to the retraction crank shaft 180 on the output side of the retraction clutch. When the retraction clutch is engaged, the encoder 250 provides output pulses as shown in FIG. 9A. The greater the divisions on the encoder wheel 236, the greater the resolution of the drift measurement. Ideally, the circumference of the encoder wheel 236 would contain 360 divisions with each pulse corresponding to one degree of rotation. When the retraction clutch is disabled, the controller starts monitoring the encoder 250 output. When the output stops varying, the cleaner has stopped moving. This length of time is the "drift". (See FIG. 9B). For example, if the "drift" for the first state or north pole (home) position (i.e. the first brush and the second brush are retracted) is initially set for 10 msec. The controller detects the north pole 31.25 msec before the desired state and waits 21.25 msec (i.e. 31.25 msec–10 msec) before disabling the clutch. 10 msec. of "drift" later, the cleaner should be in the desired state (i.e. in this case, the home position). At the same time, the drift is being measured to verify that it is indeed 10 msec. If the drift increases or decreases, the controller can adjust accordingly on the next cycle. This invention, known as a variable inertia drift controller, has the advantage of wider manufacturing tolerances and higher reliability over the life of the cleaner.

Another embodiment of the variable inertia drift controller is the use of an irregularly spaced encoder wheel to act as the retraction home position sensor. A wide pulse would indicate the presence of the home position, and a 360 division encoder would enable the controller to count 90 pulses (or 90 degrees) until the next cleaner state. The encoder pulses would still be used to compensate for changing drift as described above. The processor could perform these drift measurements every 2000 prints, for example, in a special "print quality" cycle, reducing the need for extra computing power or cost while providing the additional advantage of eliminating the need for a magnetic indexing wheel on the clutch, thus, reducing the UMC.

Figure 10:
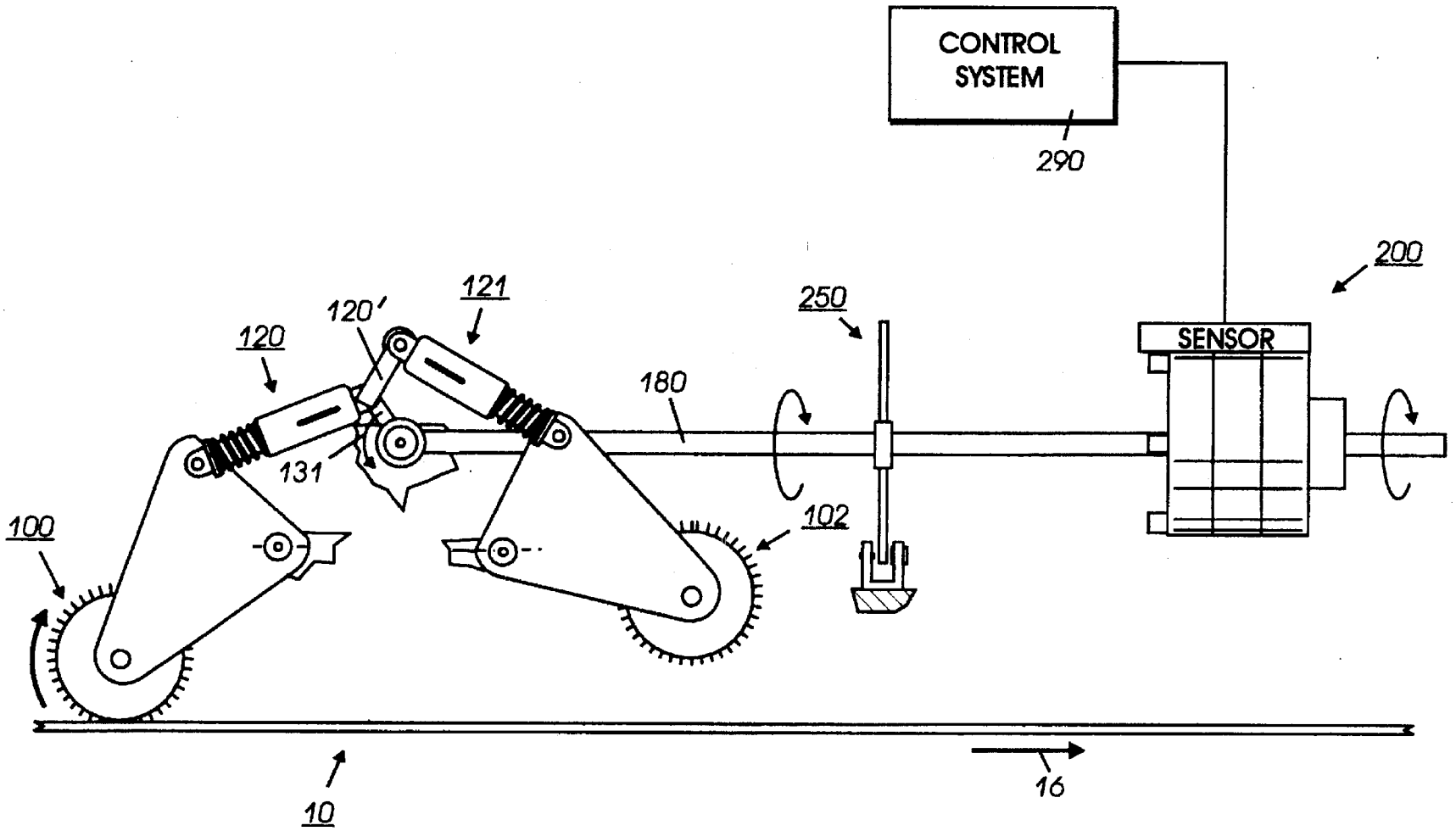
FIG. 10 is a schematic of an embodiment of the present invention using a six bar linkage retraction system with an encoder and four-position clutch.

Reference is now made to FIG. 10, which shows a schematic of an embodiment of the present invention using a six bar linkage retraction system with an encoder and a four-position clutch with a sensor. FIG. 10 shows a complete brush retraction assembly.

In recapitulation, the present invention utilizes a six bar linkage cleaner brush retraction system. The six bar linkage cleaner brush retraction system, of the present invention, is an important feature of the cleaner subsystem in printers and copiers. This mechanism enables brush retraction (and engagement with the photoreceptor) while providing good control over the brush interference and the capability of changing retraction and engagement timing parameters through clutch actuation times in software and clutch shaft speed. The mechanism is relatively inexpensive and provides retraction and engagement with relatively soft contacts to the photoreceptor to minimize impacts to photoreceptor motion quality. Another advantage of this invention is that it is adaptable to printers or copiers with tight space constraints preclude the use of larger traditional solenoids and cams. A four position clutch is used to provide magnetic pole sensor outputs to the system controller to decide when the clutch, which drives the six bar linkage, is engaged and disengaged. The index wheel of the clutch has four equally spaced magnets that are located relative to the retraction crank shaft so that there is a significant amount of time between detecting a pole and the corresponding desired state. This "significant" amount of time allows the processor to vary its clutch disable time in order to compensate for mechanical drift. An encoder is used to monitor the actual mechanical drift of each cleaner state. The measured drift is fed back to the controller which can compensate for changes in drift on the next cycle.

It is, therefore, apparent that there has been provided in accordance with the present invention, a six bar cleaner brush retraction system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for cleaning particles from a movable surface of a multipass image on image printing machine, comprising:

at least two means for cleaning the surface including a first cleaning means and a second cleaning means, said first cleaning means being located upstream from said second cleaning means in a direction of motion of the surface; and a multibar linkage, with each bar of said multibar linkage being pivotally connected to another bar of said multibar linkage, for pivotally supporting said first cleaning means and said second cleaning means, having an actual pivot point on an axis parallel to and above the surface and perpendicular to the direction of motion of said multibar linkage enabling said first cleaning means and said second cleaning means to sequentially retract from and engage with the surface, said multibar linkage controlling said cleaning means interference with the surface and enabling changeability of retraction and engagement timing parameters using software clutch actuation times.

2. An apparatus as recited in claim 1, wherein said first cleaning means comprises a first brush.

3. An apparatus as recited in claim 2, wherein said second cleaning means comprises a second brush.

4. An apparatus as recited in claim 3, wherein said multibar linkage comprises a six bar linkage.

5. An apparatus for cleaning particles from a movable surface of a multipass image on image printing machine, comprising:

cleaning brushes, including a first cleaning brush and a second cleaning brush, said first cleaning brush being located upstream from said second cleaning brush in a direction of motion of the surface; and a mechanism for pivotally supporting said first cleaning brush and said second cleaning brush, having an actual pivot point on an axis parallel to and above the surface and perpendicular to the direction of motion of said mechanism enabling said first cleaning brush and said second cleaning brush to sequentially retract from and engage with the surface, said mechanism comprises a multibar linkage, having a six bar linkage, with each bar of said multibar linkage being pivotally connected to another bar of said multibar linkage, said six bar linkage comprises:

a frame link being the endplate of the printing machine for said first brush and said second brush;

a first follower link for said first brush having a first follower pivot, said first follower link having one end pivotally connected to one end of said frame link at the first follower pivot;

coupler links including a first coupler link and a second coupler link, said coupler links being compressible, said first coupler link, having an extension connected to one end, the extension being pivotally connected to said second coupler link on an end opposite said first coupler link and said first coupler link being pivotally connected to said first follower link on an end opposite the extension;

a crank link having a driving means, being coupled on one end to an intersection of said first coupler link and the extension on one end, and being coupled on an opposite end of said crank link to a crank pivot, said crank link being mounted on said frame link between said first brush and said second brush; and a second follower link for said second brush having a second follower pivot, said second follower link having one end pivotally connected to another end of said frame link at the second follower pivot, opposite the end of said frame link attached to the first follower pivot, said second follower link being pivotally connected to said second coupler link on an end opposite to the first coupler link.

6. An apparatus as recited in claim 5, wherein said coupler links are spring loaded.

7. An apparatus as recited in claim 6, wherein the crank pivot is located between the first follower pivot and the second follower pivot, the crank pivot being coupled to a third end of said frame link.

8. An apparatus as recited in claim 7, wherein said crank being rotatable, enables said first follower and said second follower to move said first brush and said second brush toward and away from the surface.

9. An apparatus as recited in claim 8, wherein said second brush lags behind engagement and retraction of said first brush by an amount of time required for an interdocument zone of the surface to move a distance between said first brush and said second brush.

10. An apparatus as recited in claim 9, wherein said driving means being movable between positions including a home position, a first position, a second position, a third position, and a fourth position.

11. An apparatus as recited in claim 10, wherein the home position comprises said first brush and said second brush, located downstream from said first brush in the direction of motion of the surface, being retracted away from the surface.

12. An apparatus as recited in claim 11, wherein the first position of said driving means comprises said first brush being engaged with an interdocument zone of the surface and said second brush being midway between a retracted home position and contact with the surface as said second brush moves toward the surface.

13. An apparatus as recited in claim 12, wherein the second position of said driving means comprises the multi-bar linkage enabling said first brush to remain in contact with the surface, by stopping pivotal movement of said first follower link and compressing said first coupler link, said second brush continuing movement from midway between the retracted home position and contact with the surface, simultaneously with movement of the interdocument zone of the surface such that said second brush contacts the interdocument zone of the surface.

14. An apparatus as recited in claim 13, wherein the third position of said driving means comprises said first brush being retracted midway between the surface and the home position and said second brush remaining in contact with the surface by stopping pivotal movement of said second follower link and compressing said second coupler link.

15. An apparatus as recited in claim 14, wherein the fourth position of said driving means further retracts said first brush to the home position and fully retracts the second brush to the home position.

16. An apparatus as recited in claim 15, wherein said driving means comprises a clutch.

17. An apparatus as recited in claim 16, wherein said clutch comprises:

an index wheel, having a circumference;

four magnetic poles provided from four magnets spaced equidistance around the circumference of said index wheel, three of said magnetic poles being magnetic south and one of said magnetic poles being magnetic north;

a driving shaft being rotatable, passing through said index wheel of said clutch; and a sensor for detecting said magnetic poles being passed as said driving shaft rotates.

18. An apparatus as recited in claim 17, wherein said driving shaft having an encoder therealong adjacent to and separate from the clutch.

19. An apparatus as recited in claim 18, wherein said encoder monitors mechanical drift of each of the positions, said magnetic poles having sensor outputs that are made available to a system controller that engages and disengages the clutch.

20. An apparatus as recited in claim 19, wherein the system controller adjusts the timing of the clutch to enable said first brush and said second brush to engage and retract from the surface within the inderdocument zone independent of variations in mechanical drift.

21. An apparatus as recited in claim 16, wherein said clutch comprises a separate, irregularly spaced encoder wheel having long pulses and short pulses.

22. An apparatus as recited in claim 21, wherein the long pulses have about 90 degrees therebetween.

23. An apparatus as recited in claim 22, wherein the system controller adjusts the timing of the clutch to enable said first brush and said second brush to engage and retract from the surface within the interdocument zone independent of variations in mechanical drift.

* * * * *